US006047105A

United States Patent [19]

Lentz

[11] Patent Number: 6,047,105

[45] Date of Patent: Apr. 4, 2000

[54] OFF PEAK ELECTRIC HEAT STORAGE AND DISCHARGE DEVICE

[76] Inventor: Ervin Carl Lentz, 189 Galtier Pl., St. Paul, Minn. 55126

[21] Appl. No.: 07/852,990

[22] Filed: Mar. 16, 1992

[51] Int. Cl.[7] ..... F24H 7/04

[52] U.S. Cl. ..... 392/341; 219/530; 392/485

[58] Field of Search ..... 392/341, 344, 392/346, 358, 485; 219/530, 540; 4/524; 165/104.15, 104.16, 902

[56] References Cited

U.S. PATENT DOCUMENTS

| | | | |
|---|---|---|---|
| 796,684 | 8/1905 | Thomson | 392/341 |
| 1,054,409 | 2/1913 | Harrison et al. | 392/344 |
| 2,670,426 | 2/1954 | Stone | 392/485 |
| 3,141,454 | 7/1964 | Laing | 392/341 |
| 3,381,113 | 4/1968 | Jacques et al. | 392/341 |
| 3,497,674 | 2/1970 | Zirngibl et al. | 392/485 |
| 3,823,305 | 7/1974 | Schroder | 392/344 |
| 4,222,365 | 9/1980 | Thomson | 126/400 |
| 4,286,141 | 8/1981 | MacCracken | 392/346 |
| 5,542,022 | 7/1996 | Zauderer | 392/485 |

FOREIGN PATENT DOCUMENTS

| | | | |
|---|---|---|---|
| 2721173 | 11/1978 | Germany . | |
| 207030 | 2/1984 | Germany | 392/344 |
| 59-122893 | 7/1984 | Japan . | |
| 604196 | 4/1978 | U.S.S.R. | 392/485 |
| 620756 | 8/1978 | U.S.S.R. | 392/485 |
| 1022546 | 3/1966 | United Kingdom | 392/346 |
| 1065662 | 4/1967 | United Kingdom | 392/344 |
| 1155752 | 6/1969 | United Kingdom | 392/344 |
| 1255377 | 12/1971 | United Kingdom | 392/344 |
| 2227557 | 8/1990 | United Kingdom | 392/345 |

*Primary Examiner*—John A. Jeffery
*Attorney, Agent, or Firm*—Alan Kamrath; Oppenheimer, Wolff & Donnelly LLP

[57] ABSTRACT

An off-peak electric heat storage and discharge device includes variably sized thermal media material contained in a rock box. A calrod-type heating element is located in and in direct thermal contact with the thermal media material. Air flow can move from a fan upwardly through a duct, through slots formed in the duct into the rock box, and through the thermal media material. Air flow can also move from the fan through a bypass duct. Heated air and cold air can be mixed in proper proportions by a rotatable damper movable between a position closing off all cold, bypass air and a position closing off all heated air. The damper falling to shut off the flow of heated air in the event of an actuator failure. All electric controls and the fan are contained in a vertical control chamber designed to convectively convey heat during static conditions. The thermostat for the device is located at the lowest point possible in the vertical control chamber and below a point which could be affected by convective air flow.

18 Claims, 2 Drawing Sheets

OFF PEAK ELECTRIC HEAT STORAGE AND DISCHARGE DEVICE

BACKGROUND OF THE INVENTION

In certain areas of the country, such as Central and North Florida, winter weather gets cold enough to require early morning heating, typically between the hours of 7 Am to 11 Am, and the practice has been to heat with electric heaters. When great numbers of said electric heaters are used simultaneously, a large peak power demand is created such that near brownout conditions can occur. The purpose of the invention is to allow the utility to shift the direct on-line early morning heat load to the previous night when power is readily available, by providing small heaters which store electric heat in suitable thermal media, and then deliver the heat to a room or area of a room as needed during the morning hours, under control of self contained adjustable thermostats. U.S. Pat. No. 4,686,959 is an example of a prior thermal storage furnace system for that purpose.

The small heaters may be used in multiple with one being plugged into a normal 15 amp wall circuit operating at 120 volts alternating current. The storage and discharge modes of the heaters, which can also be used as conventional heaters, are remotely controlled by the utility by the use of a device installed on or in, or near each heater.

BRIEF SUMMARY OF THE INVENTION

The invention relates to an off peak electric heat storage device of a size and capacity suitable for plugging into a conventional wall outlet in a residence or other structure. Said device is a preassembled unit, with a self contained adjustable thermostat, that requires no field assembly or installation work other than plugging it into a wall outlet. It has a short chain to hold it to the wall. The heating element is permanently embedded in and in direct contact with the thermal (heat storage) media, and the whole contained in a preassembled heavy gauge steel box, which may be made from low cost temperature resistant materials, such as Aluminized steel, or other medium temperature range materials. Said box is surrounded with suitable supporting insulation and contained in a painted or vinyl clad galvanized steel outer cover. A discharge fan, adjustable thermostat, other controls, and utility operated radio switch are contained within a vertical chamber located on the right side of the device. A thermostatically controlled fail safe damper regulates outlet air temperature to a preset level.

BRIEF DESCRIPTION OF THE DRAWINGS

The invention may be understood and further advantages and uses thereof more readily apparent, when considered in view of the following detailed description of exemplary embodiments, with accompanying drawings, in which.

DESCRIPTION OF THE PREFERRED EMBODIMENT

Figure 1:
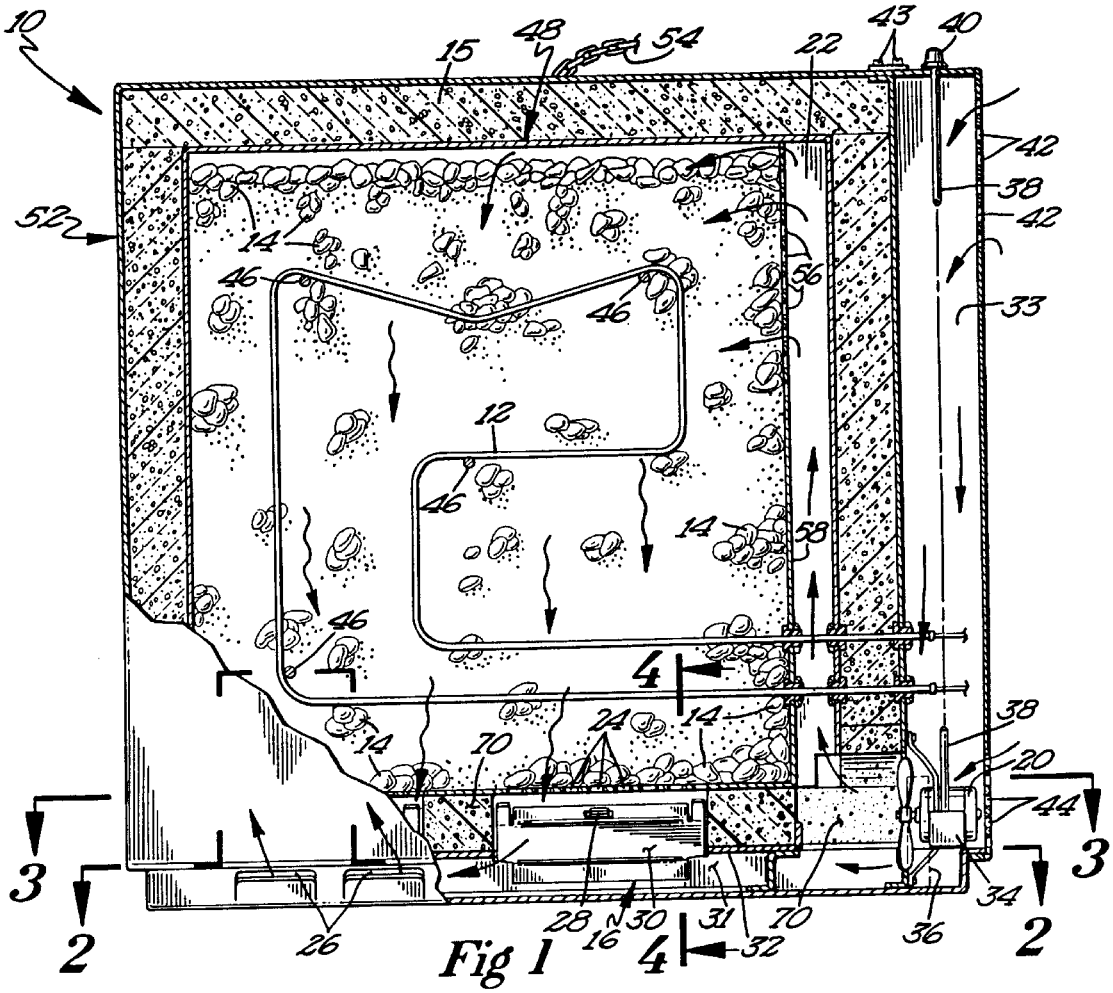
FIG. 1 shows a cross-sectional view of an off-peak electric heat storage and discharge device constructed according to the teachings of the present invention.
Figure 2:
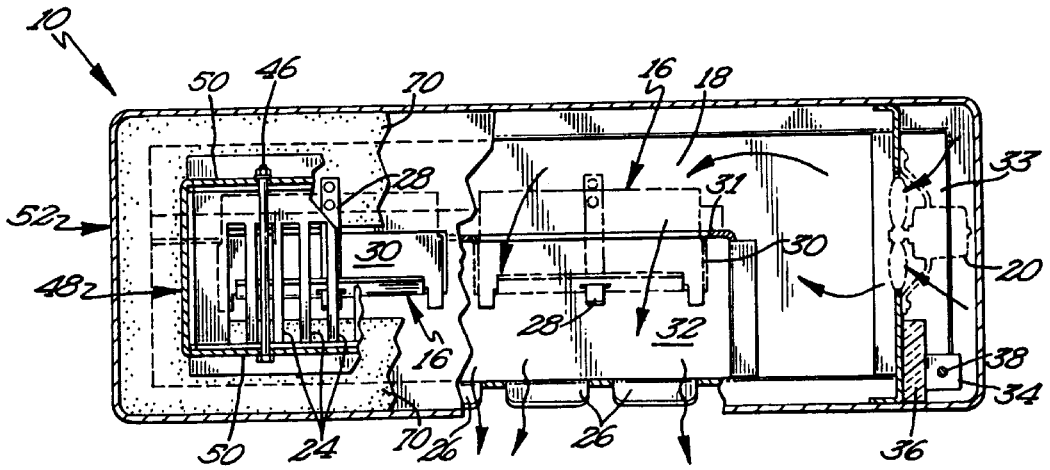
FIG. 2 shows a cross-sectional view of the off peak electric storage and discharge device of FIG. 1 according to section line 2—2 of FIG. 1.
Figure 3:
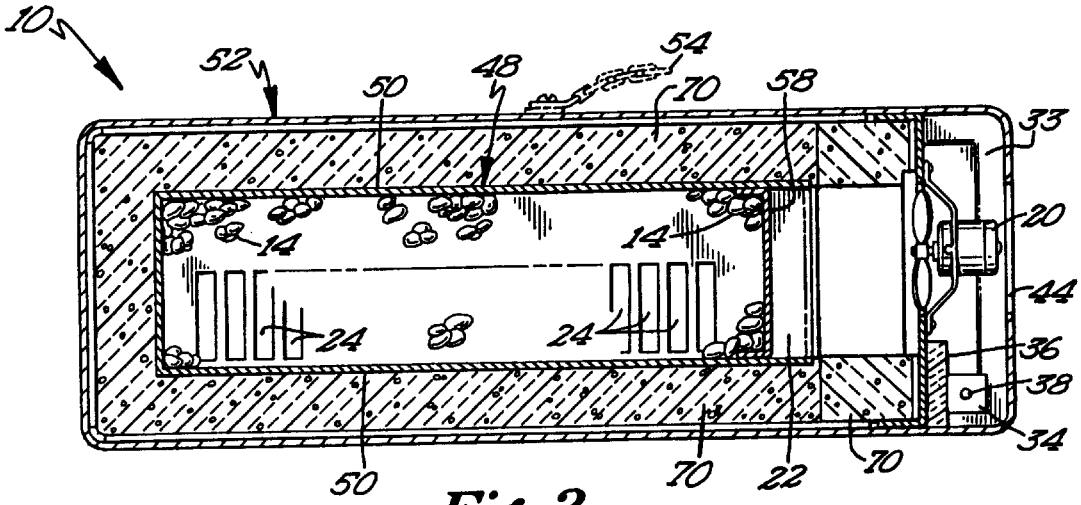
FIG. 3 shows a cross-sectional view of the off peak electric storage and discharge device of FIG. 1 according to section line 3—3 of FIG. 1.

An off-peak electric heat storage and discharge device according to the teachings of the present invention is shown in the drawings and generally designated 10. Device 10 heats the interior of a structure or housing by means of circulating a heated fluid. Particularly, heat storage and discharge device 10 includes heating means 12 for heating a fluid suitable for convection or conductive heating, such as for instance ambient air, heat storage means 14 for storing heat therewithin, insulation materials 15 which can be either rigid or granular, painted or vinyl clad steel outer cover 52 which has short chain 54 attached thereto, mixing means 16 for mixing heated fluid from heat storage means 14 and/or heating means 12 with unheated fluid, such as for example, the cold fluid return of the interior volume of the structure or space to be heated, from heat storage means bypass duct 18, and fluid moving means 20 for moving fluid within heat storage device. Chain 54 ties device 10 to a wall to prevent tipover and is only long enough to reach the nearest stud or to the closest point of any other wall material.

Heating means 12 in the preferred form is a calrod-type heating element. Heat storage means in the preferred form is a thermal media such as crushed rock, stream pebbles, agglomerated ash particles with suitable binding and other ingredients which may enhance heat resistance and/or storage, or other acceptable, variably sized material capable of surviving repeated temperature cycling. Heat storage means 14 is in direct contact with heating means 12, and is contained in box 48 which has tiebolt 46 to constrain sidewalls 50 from bulging due to expansion of thermal media 14 upon heating. Heating means 12 in the preferred form of a calrod-type heating element is positioned in box 48, in heat storage means 12 in the preferred form of variably sized material, and on tiebolts 46. Heating temperatures and storage temperatures are kept to the medium range so that heat storage means 12 is less apt to disintegrate to permit use of medium range temperature materials, such as Aluminized steel, instead of more costly high temperature stainless steel, and the use of low cost insulation materials with no organic binders to burn out and smell on startup, and to lessen heat transfer through the insulation, to reduce radiation heat losses. Solid insulation blocks 70, such as compressed vermiculite, position and support rock box 48. Insulation materials 15 in the preferred form are granular such as expanded perlite fill all other voids surrounding rock box 48.

A duct 22 is formed by a partition 58 extending between sidewalls 50 of box 48 spaced from an end wall thereof. The lower end 60 of duct 22 is open and the upper end includes slots 56 into box 48 and arrayed so that uniform flow through heat storage means 14 is achieved. Fluid from fluid moving means 20 in the preferred form being air moved by a fan can move either upwardly through duct 22 through slots 56 into heat storage means 14 and thence downwardly toward mixing means 16, or horizontally through heat storage means by pass duct 18 to mixing means 16, typically a thermostatically activated fail safe bimetal damper arrangement, which mixes cold air from duct 18 with hot air from heat storage means 14 via slots 24 in proper proportions to deliver mixed air to the structure via upwardly directional outlet openings 26 at predetermined acceptable temperatures.

Care is taken to provide a predetermined amount of hot air leakage in mixing means 16 to raise the delivered temperature during initial discharge, as this is desired by the occupants, while the decay of storage temperature over time naturally causes the delivered temperature to drop, an acceptable feature since the structure is warming up and its heat requirement is dropping due to the warming of the day.

Figure 4:
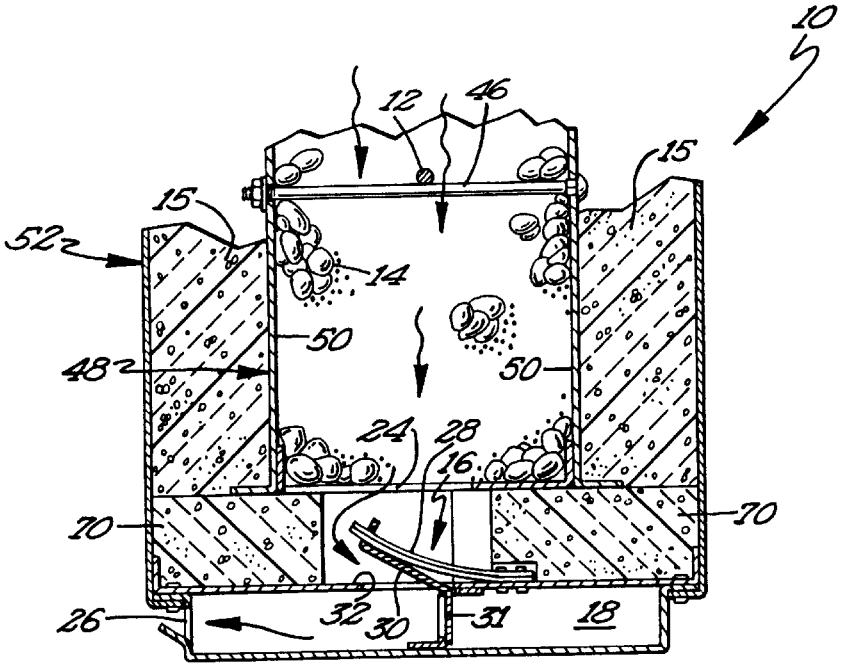
FIG. 4 shows a partial cross-sectional view of the off peak electric storage and discharge device of FIG. 1 according to section line 4—4 of FIG. 1.

FIG. 4 shows the bimetal actuator 28 and damper 30 assembly in a position where the heat storage level is at or below the mixed air delivery temperature. In this position the cold bimetal has rotated damper 30 until the lower leg of damper 30 is vertically sealingly in contact with its mating metal surface 31 closing off all by pass air from duct 18, while maximizing air flow from heat storage means 14 via slots 24. This condition occurs at or near the end of a discharge period, or when the heater is used in "normal" (not off peak) load management mode, when heat being produced by heating means 12 is directly being delivered to the structure.

Conversely when heat storage level is high such as at or near the beginning of discharge, the bimetal actuator 28 lowers/rotates damper 30 downwardly in a position shown in phantom in FIG. 4 reducing the flow of hot air from heat storage means 14 via slots 24 and allowing cold air to flow from by pass duct 18 to temper the mixed air to desired level. Thus damper 30 controllably mixes heated fluid with unheated fluid so that the heated fluid delivered to the structure or housing is at a predetermined level. This predetermined level may gradually decrease as stored heat is depleted. In case bimetal spring actuator 28 fails, damper 30 with more than half of its mass above sealing surface 32, will fall, shutting off the flow of hot air.

Vertical controls chamber 33 contains all electrical controls and wiring and is designed to convectively convey heat which reaches it from heat storage means 14 upwardly and out through slots 42 at the top of the chamber during static conditions. During operation of fan 20 air is drawn through the chamber via slots 44 and possibly slots 42 to remove heat. Thus, cooling during operation of fan 20 does not depend on convective flow because air moved by fan 20 is drawn through vertical control chamber 33. Adjustable bimetal thermostat 34 is located at the lowest point possible to keep it away from heat storage means 14 heat, and below the point at which thermostat 34 could be affected by convective air flow and is further protected by rigid insulation blocks 36 behind and to its right. The positioning of thermostat 34 as well as fan 20 within vertical control chamber 33 provides for convective air flow cooling under static conditions. Thus, thermostat 34 is prevented from being influenced by other than ambient temperature. In order to locate the thermostat at the lowest point and still permit certain persons to reach its knob 40 without bending shaft extension 38 is provided which allows placement of the control point at the top of the heater next to indicator lights 43.

What is claimed is:

1. Heat storage and discharge device comprising, in combination: means for storing heat in the form of variably sized material contained in a shape; means for heating the heat storing means located within and in direct contact with the variably sized material forming the heat storing means; means for moving a fluid; and means for directing the flow of fluid from the moving means through the variably sized material forming the heat storing means wherein the heat storing means is contained in the shape by a box having sidewalls, wherein the heat storage and discharge device further comprises, in combination: tie bolts extending between the sidewalls to constrain the sidewalls from bulging, with the heating means being supported in the box on the tiebolts.

2. The heat storage and discharge device of claim 1 wherein the heating means comprises a calrod-type heating element.

3. The heat storage and discharge device of claim 1 further comprising, in combination: a vertical control chamber having a top and a bottom, with the moving means located in the vertical control chamber and drawing fluid from adjacent the bottom of the control chamber for movement into the directing and bypassing means; and means located adjacent to the top of the vertical control chamber for allowing fluid flow, with heated fluid convectively conveyed upwardly out of the fluid allowing means during static conditions.

4. The heat storage and discharge device of claim 3 further comprising, in combination: a thermostat for controlling operation of the fluid moving means, with the thermostat located in the vertical control chamber at the lowest point possible adjacent to the bottom of the vertical control chamber and below a point which could be affected by convective air flow.

5. Heat storage and discharge device comprising, in combination: means for storing heat; means for heating the heat storing means; means for moving a fluid; means for directing the flow of fluid from the moving means for the receipt of heat from the heat storing means, with the directing means having an outlet; means for bypassing the flow of fluid from the moving means from the heat storing means, with the bypassing means having an outlet; and means for mixing the fluid flow from the directing and bypassing means comprising, in combination: a damper having a first leg and a second leg extending to a non-linear angle from the first leg; means for rotatably mounting the damper between a first position with the first leg sealing the outlet of the directing means and the second leg being spaced from the outlet of the bypassing means to permit fluid flow through the bypassing means and a second position with a second leg sealing the outlet of the bypassing means and the first leg being spaced from the outlet of the directing means to permit fluid flow through the direction means; and means responsive to temperature for moving the damper between the first and second positions.

6. The heat storage and discharge device of claim 5 wherein the damper is biased to its first position in case of failure of the temperature responsive means.

7. The heat storage and discharge device of claim 6 wherein the outlet of the directing means is horizontally arranged, with the first leg being horizontal in the first position, wherein the mass of the first leg is greater than the second leg to bias the damper to rotate to the first position.

8. The heat storage and discharge device of claim 7 wherein the temperature responsive means is a bimetal actuator located in the directing means.

9. The heat storage and discharge device of claim 5 wherein the heat storing means is in the form of variably sized material contained in a shape, with the fluid flowing through the variably sized material forming the heat storing means.

10. The heat storage and discharge device of claim 9 wherein the heating means is located within and in direct contact with the variably sized material forming the heat storing means.

11. The heat storage and discharge device of claim 10 wherein the heating means comprises a calrod-type heating element.

12. The heat storage and discharge device of claim 11 wherein the heat storing means is contained in the shape by a box having sidewalls, wherein the heat storage and discharge device further comprises, in combination: tiebolts extending between the sidewalls to constrain the sidewalls from bulging, with the heating means being supported in the box on the tiebolts.

13. The heat storage and discharge device of claim 5 further comprising, in combination: a vertical control chamber having a top and a bottom, with the moving means located in the vertical control chamber and drawing fluid from adjacent the bottom of the control chamber for movement into the directing and bypassing means; and means located adjacent to the top of the vertical control chamber for allowing fluid flow, with heated fluid convectively conveyed upwardly out of the means for allowing fluid flow during static conditions.

14. The heat storage and discharge device of claim 13 further comprising, in combination: a thermostat for controlling operation of the fluid moving means, with the thermostat located in the vertical control chamber at the lowest point possible adjacent to the bottom of the vertical control chamber and below a point which could be affected by convective air flow.

15. The heat storage and discharge device of claim 14 further comprising, in combination: an extension shaft extending from the top of the vertical control chamber to and attached to the thermostat.

16. The heat storage and discharge device of claim 5 wherein the outlets of the directing and bypassing means are generally perpendicular to each other, with the first and second legs of the damper being at an obtuse angle.

17. Heat storage and discharge device comprising, in combination: means for storing heat; means for heating the heat storing means; means for moving a fluid; means for directing the flow of fluid from the moving means for receipt of heat from the heat storing means; a vertical control chamber having a top and a bottom, with the top of the vertical control chamber extending above at least a portion of the means for storing heat, with the moving means located in the vertical control chamber and drawing fluid from adjacent the bottom of the control chamber for movement into the directing means; and means located adjacent to the top of the vertical control chamber for allowing fluid flow, with heated fluid convectively conveyed upwardly out of the fluid allowing means during static conditions.

18. The heat storage and discharge device of claim 17 further comprising, in combination: a thermostat for controlling operation of the fluid moving means, with the thermostat located in the vertical control chamber at the lowest point possible adjacent to the bottom of the vertical control chamber and below a point which could be affected by convective air flow.

* * * * *